US009331433B2

(12) United States Patent
Ueda et al.

(10) Patent No.: US 9,331,433 B2
(45) Date of Patent: May 3, 2016

(54) CONNECTOR

(71) Applicant: Japan Aviation Electronics Industry, Limited, Tokyo (JP)

(72) Inventors: Kouhei Ueda, Tokyo (JP); Yohei Yokoyama, Tokyo (JP); Masaaki Takaku, Tokyo (JP); Takushi Yoshida, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/693,151

(22) Filed: Apr. 22, 2015

(65) Prior Publication Data

US 2016/0013591 A1 Jan. 14, 2016

(30) Foreign Application Priority Data

Jul. 8, 2014 (JP) ..... 2014-140550

(51) Int. Cl.
*H01R 13/648* (2006.01)
*H01R 13/6581* (2011.01)
*H01R 13/6596* (2011.01)

(52) U.S. Cl.
CPC ..... *H01R 13/6581* (2013.01); *H01R 13/6596* (2013.01)

(58) Field of Classification Search
CPC .. H01R 13/6581; H01R 13/6596; H01R 4/02; H01R 4/187; H01R 13/658; H01R 13/6587; H01R 23/7063; H01R 43/0221
USPC ..... 439/607.28, 607.01, 607.09, 607.11, 439/607.13, 607.27, 607.35, 607.36, 439/607.54, 919, 108
See application file for complete search history.

(56) References Cited

U.S. PATENT DOCUMENTS 7,758,379 B2 * 7/2010 Chen ..... H01R 13/6485 439/607.11
8,262,411 B2 * 9/2012 Kondo ..... H01R 13/6658 439/607.01
8,851,927 B2 * 10/2014 Hsu ..... H01R 13/6594 439/607.11
8,968,031 B2 * 3/2015 Simmel ..... H01R 13/659 439/108
9,209,573 B1 * 12/2015 Chen ..... H01R 13/6581
2015/0303629 A1 * 10/2015 MacDougall ..... H01R 24/70 439/607.01
2015/0311645 A1 * 10/2015 Chang ..... H01R 13/6581 439/607.28

FOREIGN PATENT DOCUMENTS

JP 2008-173657 A 7/2008

* cited by examiner

*Primary Examiner* — Neil Abrams
*Assistant Examiner* — Travis Chambers
(74) *Attorney, Agent, or Firm* — Muncy, Geissler, Olds & Lowe PC

(57) ABSTRACT

A connector includes at least one contact, a ground plate formed of a metal plate of a predetermined thickness, an insulator that holds the at least one contact and the ground plate, and a metal shell that covers an outer periphery portion of the insulator, the metal shell having a window section formed facing the ground plate and having a thickness greater than the thickness of the metal plate which forms the ground plate, the ground plate having a shell fixing section formed by folding and overlapping the metal plate and located to contact the window section from inside the metal shell, a periphery of the window section of the metal shell and the shell fixing section of the ground plate being welded to each other inside the window section of the metal shell.

5 Claims, 4 Drawing Sheets

CONNECTOR

BACKGROUND OF THE INVENTION

The present invention relates to a connector, and more particularly, to a connector in which an outer periphery portion of an insulator is covered with a metal shell, and a ground plate held by the insulator is disposed inside the metal shell.

Recently, electronic devices such as computers and portable telephones have been widely used. These electronic devices are usually provided with a connector used to send and receive electric signals and power to and from external apparatuses. As a connector of this type, a connector having a countermeasure against electromagnetic interference (EMI) by covering the outer periphery portion of the insulator which holds contacts, with a metal shell is desirable in order to prevent the electric signals being transmitted through the connector from being affected by electromagnetic waves entering from outside, and in order to prevent electromagnetic wave noise generated by the electric signals being transmitted through the connector from affecting electronic devices in the vicinity.

In a connector with a metal shell of this type, a further attempt is made to have a connector configuration in which a ground plate adjacent to a contact is held by an insulator, and is disposed inside the metal shell, so that when the connector is fitted into a mating connector, a ground terminal of the mating connector is brought into contact with the ground plate.

In such a connector, it is necessary to electrically connect the ground plate disposed inside the metal shell and the metal shell.

Thus, in order to ensure the connection between the ground plate and the metal shell, a method is considered in which laser light, for example, is irradiated to the metal shell from outside with a portion of the ground plate being in contact with an inner surface of the metal shell, so that the ground plate and the metal shell are laser-welded together while being in contact with each other.

However, because the metal shell of the connector is required to have a mechanical strength greater than that of the ground plate, when configuring a small connector, in particular, the thickness of the metal shell is set to a value greater than the thickness value of the ground plate. Therefore, in an attempt to weld the metal shell and the ground plate by irradiating laser light from outside the metal shell, it is necessary to use laser light having an output strong enough to melt the metal shell. However, such laser light can also easily melt and pass through the ground plate which is thinner than the metal shell, causing connector components located further inside the ground plate, to be damaged by laser light.

For example, in JP 2008-173657 A, a method is disclosed, as shown in FIG. 10, in which when bonding a conductor 2 to a connecting section of a segment 1 of a commutator, a through-hole 3 is formed in the segment 1, and the conductor 2 is located so as to fill up one end of the through-hole 3, and laser light L is irradiated from the other end of the through-hole 3 through the through-hole 3 to the conductor 2, so that the segment 1 and the conductor 2 are laser-welded.

In the method described in JP 2008-173657 A, because laser light L is irradiated to the conductor 2 through the through-hole 3 formed in the segment 1, it is not necessary to use laser light L having an output strong enough to melt and pass through the segment 1 in a thickness direction. Laser light L with a small output may be used to weld the segment 1 and the conductor 2.

However, in a small connector, a ground plate located in a metal shell is formed to be very thin. Therefore, if the method described in JP 2008-173657 A is applied to weld the metal shell and the ground plate by irradiating laser light through the through-hole formed in the metal shell, it is difficult to weld the ground plate and the metal shell by melting only a part of the ground plate in a thickness direction of the ground plate, without passing through the thin ground plate. That is, there is a problem in which it is difficult to weld the metal shell and the ground plate without damaging the connector components located further inside the ground plate.

SUMMARY OF THE INVENTION

The present invention is made to solve the above-mentioned problems in the prior art and an object thereof is to provide a connector in which, while a ground plate having a thickness less than that of the metal shell is disposed inside the metal shell, the metal shell and the ground plate can be welded without damaging connector components located further inside the ground plate.

The connector according to the present invention includes at least one contact, a ground plate formed of a metal plate of a predetermined thickness, an insulator that holds the at least one contact and the ground plate, and a metal shell that covers an outer periphery portion of the insulator, the metal shell having a window section formed facing the ground plate and having a thickness greater than the thickness of the metal plate which forms the ground plate, the ground plate having a shell fixing section formed by folding and overlapping the metal plate and located to contact the window section from inside the metal shell, a periphery of the window section of the metal shell and the shell fixing section of the ground plate being welded to each other inside the window section of the metal shell.

DETAILED DESCRIPTION OF THE INVENTION

Hereinafter, embodiments of the present invention will be described with reference to the accompanying drawings.

Figure 1:
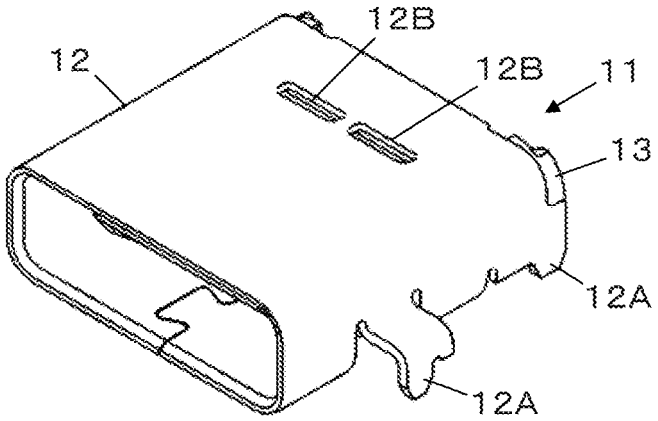
FIG. 1 is a perspective view showing a connector according to an embodiment of the present invention.

FIG. 1 shows a connector 11 according to embodiments. The connector 11 is a receptacle connector to be fixed to a substrate in electronic devices such as portable devices and information devices. The connector 11 has a metal shell 12 and an insulator 13 disposed inside the metal shell 12.

The metal shell 12 covers an outer periphery portion of the insulator 13, excluding a front section and a back section of the insulator 13 that face a fitting direction with a mating connector, and has a plurality of shell legs 12A that protrude in a direction perpendicular to the fitting direction of the connector 11, and are used for mounting to the substrate.

Also, in the metal shell 12, two window sections 12B passing through the metal shell 12 are formed side by side in a direction perpendicular to the fitting direction of the connector 11.

Figure 2:
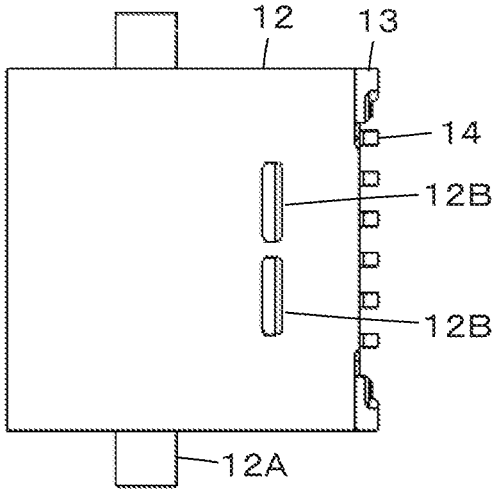
FIG. 2 is a plan view showing a connector according to the embodiment.

Also, as shown in FIG. 2, a plurality of contacts 14 are held by the insulator 13.

Figure 3:
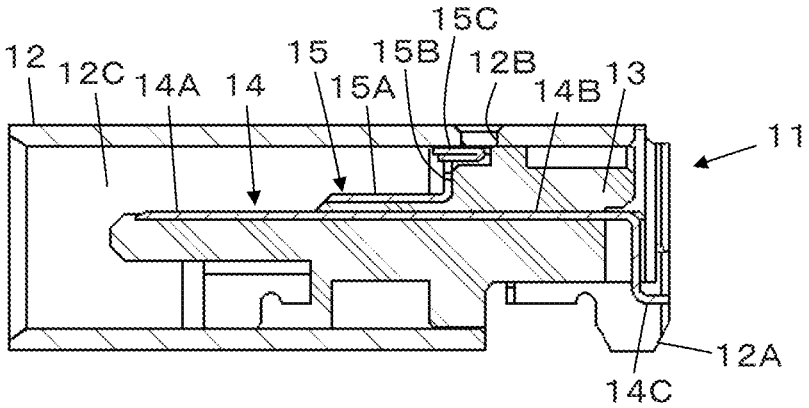
FIG. 3 is a cross-sectional view showing a connector according to the embodiment.

As shown in FIG. 3, a mating connector housing section 12C to which the mating connector is inserted, is formed inside the front end of the metal shell 12, and the insulator 13 is housed inside the back end of the metal shell 12.

Figure 9:
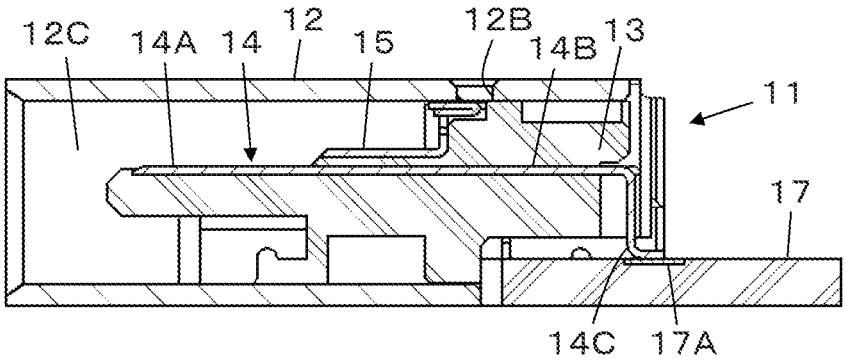
FIG. 9 is a cross-sectional view showing the connector of the embodiment mounted on a substrate, according to embodiments.
Figure 10:
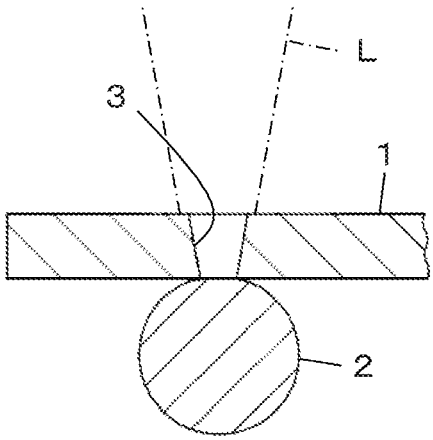
FIG. 10 PRIOR ART
FIG. 10 is a cross-sectional view showing a prior art welding method.

Each of the contacts 14 held by the insulator 13 has at its front end a contact section 14A exposed to the mating connector housing section 12C, at its middle portion an insulator fixing section 14B to be embedded and fixed in the insulator 13, and at its back end the substrate mounting section 14C to be mounted and fixed to a substrate 17 (as shown in FIG. 9). The contact section 14A is to be in contact with a contact of a mating connector inserted in the mating connector housing section 12C. The contact section 14A and the insulator fixing section 14B extend flatly on a same plane with each other. The substrate mounting section 14C to be connected to the insulator fixing section 14B bends with respect to the insulator fixing section 14B, and protrudes to the back of the insulator 13.

Also, in the insulator 13, a ground plate 15 formed of a metal plate having a predetermined thickness is held.

Figure 4:
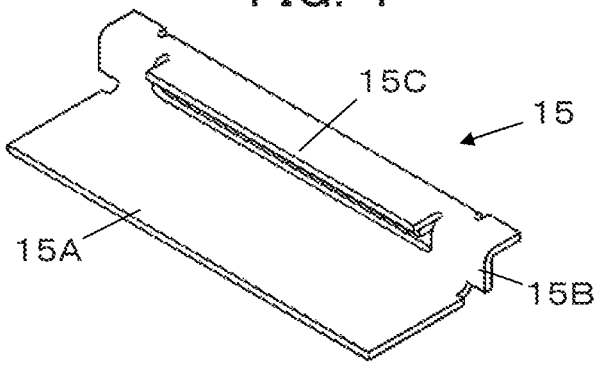
FIG. 4 is a perspective view showing a ground plate used in the connector according to the embodiment.

The ground plate 15 has, as shown in FIG. 4, a plate body 15A of an approximately rectangular flat plate shape, and a shell fixing section 15C is coupled to an end of the plate body 15A. The shell fixing section 15C extends in parallel to the plate body 15A through a rising portion 15B which rises in a direction perpendicular to the plate body 15A. The shell fixing section 15C is formed by folding the metal plate constituting the ground plate 15 into double. That is, the shell fixing section 15C has a thickness two times greater than the thickness of the plate body 15A, or more than two times if a gap is formed between the folded sheets of the metal plate.

And, as shown in FIG. 3, the ground plate 15 is held by the insulator 13 so that the plate body 15A is parallel to, and adjacent to the insulator fixing sections 14B of the plurality of the contacts 14, and an upper surface of the plate body 15A is exposed to the mating connector housing section 12C of the metal shell 12.

Figure 5:
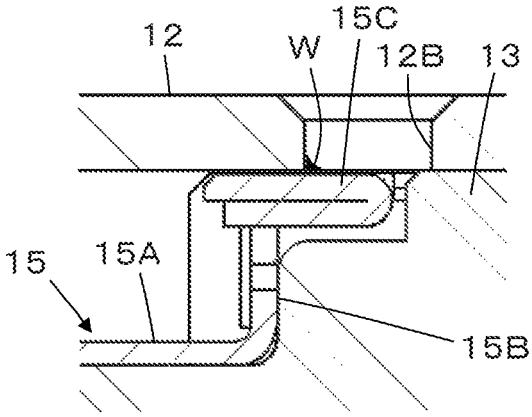
FIG. 5 is a partial cross-sectional view showing a window section of a metal shell and a shell fixing section of the ground plate.

In addition, due to the presence of the rising portion 15B, the shell fixing section 15C of the ground plate 15 is located further than the plate body 15A away from the insulator fixing sections 14B of the contacts 14, and disposed as high as the upper end of the insulator 13. Therefore, as shown in FIG. 5, the shell fixing section 15C is in contact with the window section 12B from inside of the metal shell 12, and a part of the shell fixing section 15C is exposed to outside the metal shell 12 through the window section 12B.

Inside the window section 12B, a welding section W is formed between the periphery of the window section 12B and the shell fixing section 15C. That is, the periphery of the window section 12B and the shell fixing section 15C are welded together, whereby the metal shell 12 and the ground plate 15 can be electrically connected.

Figure 6:
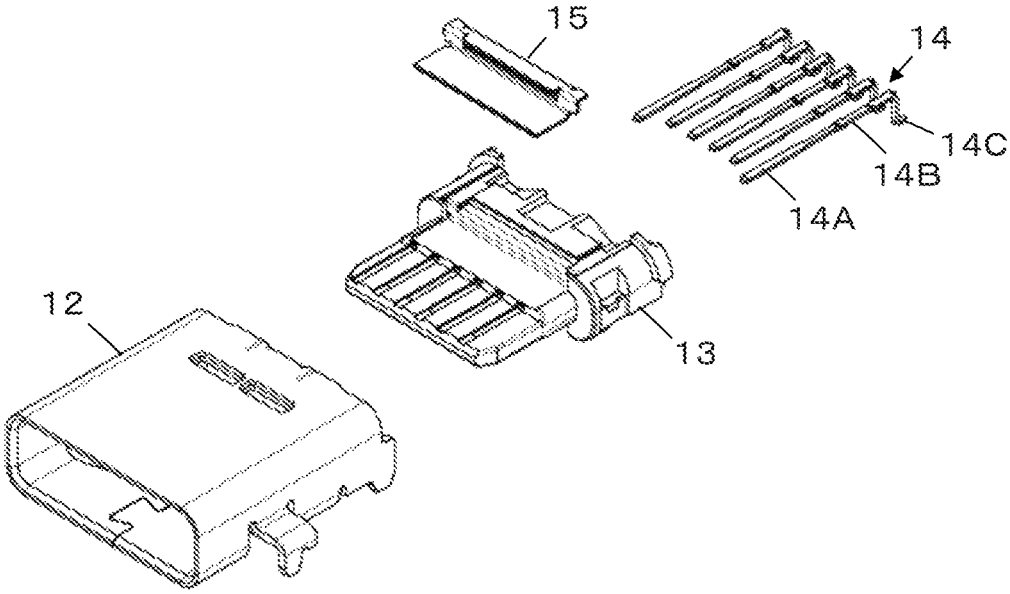
FIG. 6 is an assembly diagram of a connector according to the embodiment.

Such a connector 11 can be manufactured, as shown in FIG. 6, by insert-molding the plurality of the signal contacts 14 and the ground plate 15 together with a resin which forms the insulator 13 so that the insulator fixing sections 14B of the plurality of the signal contacts 14 are embedded in the insulator 13, and the ground plate 15 is held by the insulator 13, and then by pressing the insulator 13 into inside the metal shell 12, and by forming the welding section W between the periphery of the window section 12B of the metal shell 12 and the shell fixing section 15C of the ground plate 15.

Figure 7:
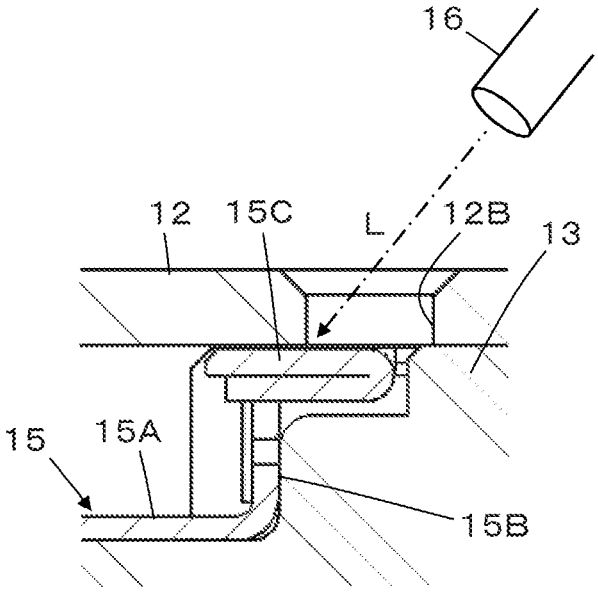
FIG. 7 is a partial cross-sectional view showing how a periphery of the window section of the metal shell is laser-welded to the shell fixing section of the ground plate.

Formation of the welding section W can be attained by, for example, as shown in FIG. 7, irradiating laser light L from a laser welder 16 through the window section 12B of the metal shell 12, to a contacting portion between the periphery of the window section 12B and the shell fixing section 15C of the ground plate 15 so that the periphery of the window section 12B and the shell fixing section 15C are welded.

At this time, since the contacting portion between the periphery of the window section 12B and the shell fixing section 15C is irradiated with laser light L through the window section 12B formed in the metal shell 12, it is not necessary to melt the metal shell 12 to pass through. Laser light L having a smaller output can be used to weld them.

In addition, since the shell fixing section 15C of the ground plate 15 is formed by folding the metal plate constituting the ground plate 15 into double, when welding the periphery of the window section 12B and the shell fixing section 15C, even if one portion of the folded metal plate which forms the shell fixing section 15C, that is in contact with the window section 12B, is melted and passed through by irradiation of laser light L, a second portion of the folded metal plate exists under the melted metal plate, whereby the connector components located further inside the connector 11 than the shell fixing section 15C, such as the insulator 13 and the contacts 14, can be protected from being damaged by laser light L.

Figure 8:
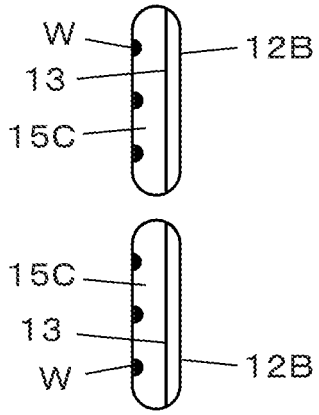
FIG. 8 is a partially enlarged plan view showing the window section of the metal shell.

In this manner, as shown in FIG. 8, in each of the two window sections 12B, for example, a welding section W is formed in each of three locations in the window section 12B, whereby the metal shell 12 and the ground plate 15 are electrically connected.

The connector 11 is used as mounted on the substrate 17, as shown in FIG. 9. The shell legs 12A of the metal shell 12 are inserted into a through hole (not shown) formed in the substrate 17, and are mounted and fixed by soldering, so that the metal shell 12 is mounted on the substrate 17, and the metal shell 12 and the ground plate 15 are connected to a ground potential through the through-hole of the substrate 17.

Also, the substrate mounting sections 14C of the signal contacts 14, are soldered and fixed to corresponding connection pads 17A on the substrate 17, respectively, to be connected to, for example, a not shown electronic circuit mounted on the substrate 17.

By inserting a not shown mating connector into the mating connector housing section 12C of the metal shell 12, by bringing corresponding contacts of the mating connector into contact with the contact sections 14A of the contacts 14, and by bringing the plate body 15A of the ground plate 15 into contact with the ground terminal of the mating connector, the connector is put into a fitting state, and the power and signals can be sent and received to and from external apparatuses.

In this way, by disposing the shell fixing section 15C formed by folding the metal plate constituting the ground plate 15 into double so as to come in contact with the window section 12B of the metal shell 12, from inside the metal shell 12, and by irradiating laser light L from outside the metal shell 12, through the window section 12B, to the contacting portion between the periphery of the window section 12B, and the shell fixing section 15C of the ground plate 15, the periphery of the window section 12B and the shell fixing section 15C are laser-welded to form the welding section W. Accordingly, the connector 11 in which the metal shell 12 and the ground plate 15 are electrically connected, without causing any damage to the connector components disposed inside the ground plate 15, while the ground plate 15 formed of the metal plate thinner than the metal shell 12 is disposed inside the metal shell 12, is achieved.

It should be noted that, while in the above mentioned embodiments, the periphery of the window section 12B and the shell fixing section 15C of the ground plate 15 are welded inside each of the two window sections 12B formed in the metal shell 12, one window section 12B, or three or more window sections 12B may be formed in the metal shell 12, and then the welding sections W may be formed inside each of the window sections 12B.

Also, while the welding section W is formed in each of the three locations in the window section 12B, the present invention is not limited to this, and the welding section W may be formed in one location, two locations or four locations or more in the window section 12B. In this regard, however, it is advantageous to perform welding at plural locations inside each of the window section 12B, for improved reliability of the electrical connection between the metal shell 12 and the ground plate 15 by welding.

While, in the above described embodiments, the shell fixing section 15C of the ground plate 15 is formed by folding the metal plate constituting the ground plate 15 into double, the present invention is not limited to this. If a space is available in the connector 11, the metal plate may be folded into triple or more, whereby a thicker shell fixing section 15C can be formed.

Further, the number of the contacts 14 to be held by the insulator 13 is not limited, as long as at least one contact 14 is held.

What is claimed is:

1. A connector comprising:

at least one contact;

a ground plate formed of a metal plate of a predetermined thickness;

an insulator that holds the at least one contact and the ground plate; and a metal shell that covers an outer periphery portion of the insulator, the metal shell having a window section formed facing the ground plate and having a thickness greater than the thickness of the metal plate which forms the ground plate, wherein the ground plate has a shell fixing section formed by folding and overlapping the metal plate and located to contact the window section from inside the metal shell, and a periphery of the window section of the metal shell and the shell fixing section of the ground plate are welded to each other inside the window section of the metal shell.

2. The connector according to claim 1, wherein the shell fixing section of the ground plate is formed by folding the metal plate into double.

3. The connector according to claim 1, wherein the contact has a contact section to be in contact with a contact of a mating connector at a front end thereof, a substrate mounting section to be mounted and fixed to a substrate at a back end thereof, and an insulator fixing section to be fixed to the insulator at a middle portion thereof, wherein the ground plate has a plate body disposed parallel to and adjacent to the insulator fixing section of the contact and a rising potion coupled to the plate body and extending away from the insulator fixing section, and wherein the shell fixing section is coupled to the rising portion.

4. The connector according to claim 1, wherein the metal shell and the shell fixing section of the ground plate are welded at each of plural locations in the window section of the metal shell.

5. The connector according to claim 1, wherein the periphery of the window section of the metal shell and the shell fixing section of the ground plate are laser-welded.

* * * * *